US006382276B1

(12) United States Patent
Daniels et al.

(10) Patent No.: US 6,382,276 B1
(45) Date of Patent: May 7, 2002

(54) ROUTER TABLE ADAPTER BASE PLATE

(75) Inventors: David R. Daniels, Lake Villa; Edmund Apolinski, Chicago, both of IL (US)

(73) Assignee: Wolfcraft, Inc., Itasca, IL (US)

( * ) Notice: Subject to any disclaimer, the term of this patent is extended or adjusted under 35 U.S.C. 154(b) by 0 days.

(21) Appl. No.: 09/862,624

(22) Filed: May 22, 2001

(51) Int. Cl.[7] ..... B27C 5/00

(52) U.S. Cl. ..... 144/135.2; 33/640; 144/1.1; 144/137; 144/371; 144/48.6

(58) Field of Search ..... 33/27.11, 613, 33/626, 640; 144/1.1, 135.2, 137, 136.95, 154.5, 286.1, 286.5, 371, 48.6; 409/182

(56) References Cited

U.S. PATENT DOCUMENTS

| | | | | | |
|---|---|---|---|---|---|
| 4,718,468 | A | * | 1/1988 | Cowman | 144/136.95 |
| 5,289,861 | A | * | 3/1994 | Hedrick | 144/48.6 |
| 5,699,844 | A | | 12/1997 | Witt | |
| 5,715,880 | A | * | 2/1998 | Tucker et al. | 144/135.2 |
| 5,725,038 | A | | 3/1998 | Tucker et al. | |
| 6,305,447 | B1 | * | 10/2001 | Rousseau | 144/135.2 |

OTHER PUBLICATIONS

Sears Owners Manual Model No. 171.25326, Craftsman Router Universal Adapter Plate, (1997), pp. 3–6.

Sears Owners Manual Model No. 171.25333, Craftsman Router Adapter Plate for Industrial Router Tables, (1997), pp. 4–8.

* cited by examiner

*Primary Examiner*—W Donald Bray
(74) *Attorney, Agent, or Firm*—Schiff Hardin & Waite

(57) ABSTRACT

The invention relates to a slotless router base plate used for mounting routers by a majority of manufacturers to a router table. A router is attached to a baseplate, and then this router-baseplate assembly is attached to a router table. Numerous hole grouping patterns are provided to accommodate various routers, eliminating the need for users of the baseplate to create holes for specific router models themselves. Slots in the router baseplate are avoided to provide for greater strength and stability in the mounting. An alternative embodiment includes providing a labeling for the hole groups. The router baseplate may be round, but alternative shapes are provided, including providing the hole pattern directly in the router table.

15 Claims, 6 Drawing Sheets

C1
E1
22
A1
20
D1
11
F1
G1
H1

20
H1
F1
28
G1
24
E1
26
D1
A1
C1

FIG. 9
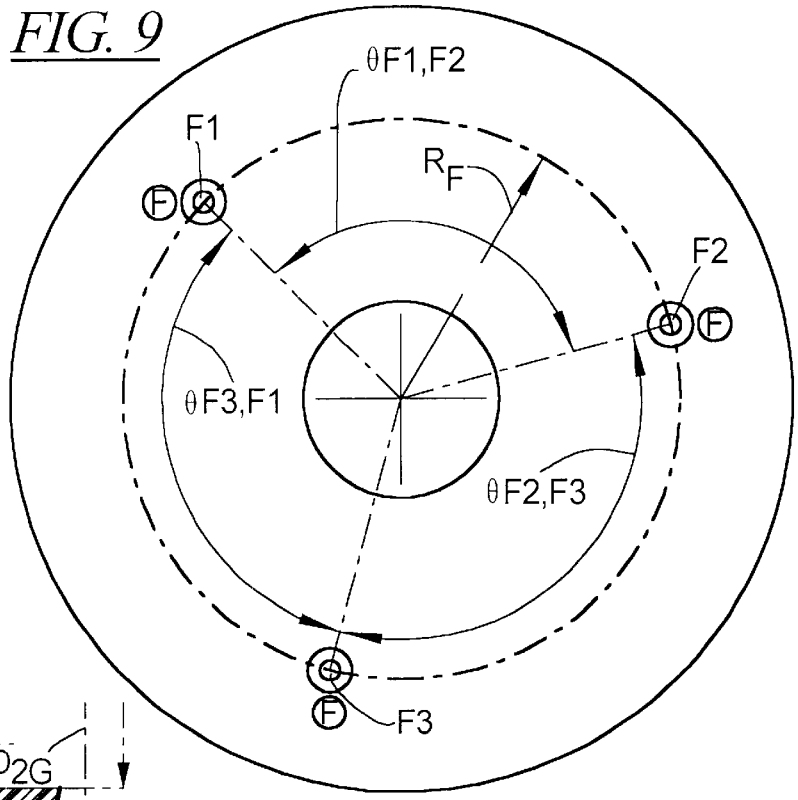
FIG. 10B
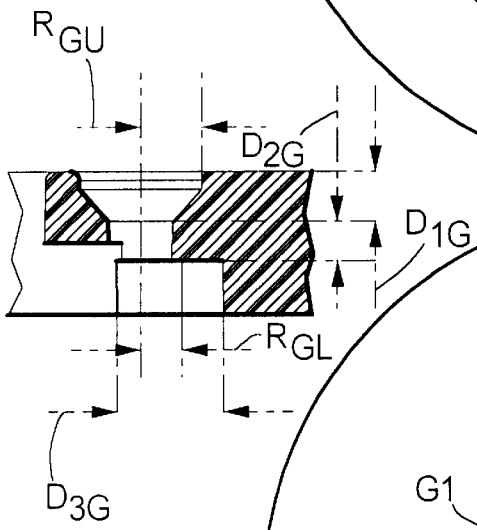
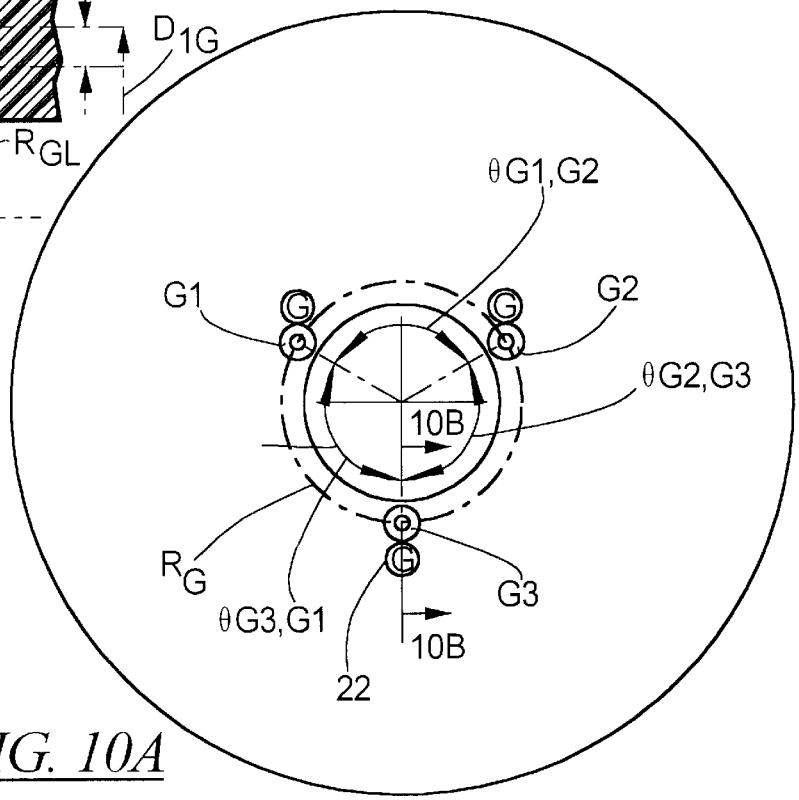
FIG. 10A

ROUTER TABLE ADAPTER BASE PLATE

BACKGROUND OF THE INVENTION

1. Field of the Invention

The invention relates to a router table adapter base plate for affixing various router models and configurations to a router table.

2. Description of the Related Art

Electric routers are used to handle a wide variety of woodworking tasks. A typical router includes an electric motor mounted inside of a housing having handles by which the router may be held and manipulated manually. The motor shaft has a collet which accepts a tool (also called a router bit or cutter); a base is attached to the housing that surrounds the cutter such that a portion of the cutter protrudes from the base when the cutter is brought into contact with the work piece. The cutter rotates and removes a small volume of the work piece each time a cutter blade engages the work piece, which is achieved by applying force between the router cutter and work piece in the direction of a cut. The base may be adjusted in parallel to the rotating axis of the motor, and the relative position of the base and cutter can change while the tool is in use by "plunging" the tool into the work piece.

Although routers are often operated by keeping the work piece stationary and moving the router relative to the fixed work piece in a free-handed manner, the router may also be mounted in a table having a wide surface to work on in an inverted position, with the cutter projecting up from the table through an opening. With the router in this stationary operating position, the work piece may be moved relative to the fixed router thus permitting an accurate manipulation of the work piece.

Such work tables are known in the art. These work tables include some mechanism for mounting the router in a fixed position with sufficient rigidity to prevent the router from moving. This mechanism typically includes either holes drilled directly in the table in a position such that the router may be fastened to the table, or it includes a base plate to which the router is fastened, with the base plate then being attached to the work table.

An example of a base plate used in this manner can be found in U.S. Pat. No. 5,725,038 which illustrates attaching a router to a baseplate, with the assembly being fixed to a work table. In this arrangement, the router is suspended with the baseplate positioned within a hole in a router table top just slightly larger than the baseplate and resting on a lip or ledge below the top surface of the table top equal to the thickness of the baseplate.

One difficulty in utilizing routers in this manner with a work table is that there is no universal standard for mounting routers. Positions of attachment mechanisms tend to vary not only from manufacturer to manufacturer, but even within a given manufacturer, depending on the size or other characteristics of the router.

In order to accommodate different router configurations, various techniques have been employed. For example, according to the Craftsman Router Adapter Plate for Industrial Router Tables: Instructions for Assembly and Installation of Your Model No. 171.25333, January, 1997, a template having concentric circles of various sizes printed on it is attached to the router adapter plate using tape. The router is placed on the adapter plate with the template on, and the location of the base plate mounting holes are marked using a pencil or felt tipped marker. Holes are then drilled at the previously marked hole positions. The template is then removed, and the router is attached to the base plate with screws going through the holes that were previously drilled.

While this technique permits a base plate to accommodate any router that has been designed with attachment screws/holes, it involves a substantial amount of work on the part of the purchaser. First, it requires that the user have a drill with the correct size drill bits on hand. Second, it requires time and effort to properly drill the required holes. The positions must be properly and accurately marked—while using the template provided is a helpful aid, it is by no means foolproof. Erroneous hole locations could still potentially result—these would be difficult if not impossible to correct. Also, the holes may be required to have a particular countersink to work properly. Purchasing the necessary tools to complete the job result in greater incurred expenses. Furthermore, this process would have to be repeated for each and every different router configuration that might be used.

In order to eliminate the step of users drilling the holes themselves, adapter plates have been created which can accommodate various router configurations. For example, the Craftsman Router Universal Adapter Plate for Assembly and Operation—Owner's Manual for Model No. 171.25326 provides an adapter plate that is pre-drilled and slotted to accommodate a number of different routers. Although the holes and slots are pre-drilled in this adapter plate, however, various mechanism are utilized by it to minimize the number of holes and slots in the plate. The use of slots to accommodate router configurations of varying sizes does allow flexibility, but results in a mounting that is not as solid as one that exclusively used holes. There is a small degree of play in the router that results from the use of slots—this results from the inherent strength and stiffness of the material from which the router plate is manufactured. Also, the additional material removed from the adapter plate to make slots, as opposed to holes, results in a weakened plate design over one that uses only holes, and is not as durable. Although the strength could be increased with other techniques such as using stronger material or making the plate thicker, these techniques would result in an increased material and production cost.

Furthermore, this design requires the use of additional countersink bushings in order to accommodate the various types of countersinks present on different router models. These countersink bushings increase the cost of an adapter plate over a design that doesn't require them, and make the plate more difficult to install.

For these reasons, it is desirable to have a router adapter base plate that can be quickly connected to a router and provides a strong mounting for the router when the plate-router assembly is mounted on a table.

SUMMARY OF THE INVENTION

The invention is based on a strong slotless router adapter plate that can accommodate a large number of different routers and that minimizes the effort required by a user to attach to a router and minimizes cost.

This object is achieved by a slotless router base plate having pre-existing holes for a large majority of the routers presently on the market present in the router plate at the time of purchase. The inventive base plate has no fewer than six hole groupings, with each hole grouping having at least two holes. Since these holes are pre-existing at the time of purchase, there is no need for the purchaser to drill any holes themselves, make use of any templates, perform the proper countersinking/counterboring, or incur any additional costs associated with adapting a router plate to a particular model router. Furthermore, the inventive base plate requires no slots, which can result in a poorer mounting and structurally weaken the base plate.

The hole groupings in the inventive base plate were selected based on extensive market research to accommodate the vase majority of routers on the market today. Broadly, the invention identifies the selection of groups and holes required to accommodate various routing configurations, but narrowly in that the precise locations of the holes, as well as the sizes and shapes (i.e., counterboring, countersinking, adaption with an inset to accommodate a nut or other fastening device) are provided.

An additional embodiment provides for an identification of holes to the hole patterns to facilitate fastening the plate to a particular router model; these identifiers may be provided as a relief within the base plate itself for durability, but may also include surface etching, painting, or some other permanent way of providing identification for the holes.

Furthermore, the inventive base plate containing the hole pattern may be round, but is not limited to the round shape. Any other appropriate geometric shape may be used, or the inventive hole pattern may be created directly in a router table to hole a router.

BRIEF DESCRIPTION OF THE DRAWINGS

The invention, together with further advantages, is explained in greater detail below with reference to the drawings.

FIG. 9 is a top view of the router base plate showing only hole pattern F;

FIG. 10*a* is a top view of the router base plate showing only hole pattern G;

FIG. 10*b* is a section view of the holes in hole pattern G;

DESCRIPTION OF THE PREFERRED EMBODIMENT

Figure 1:
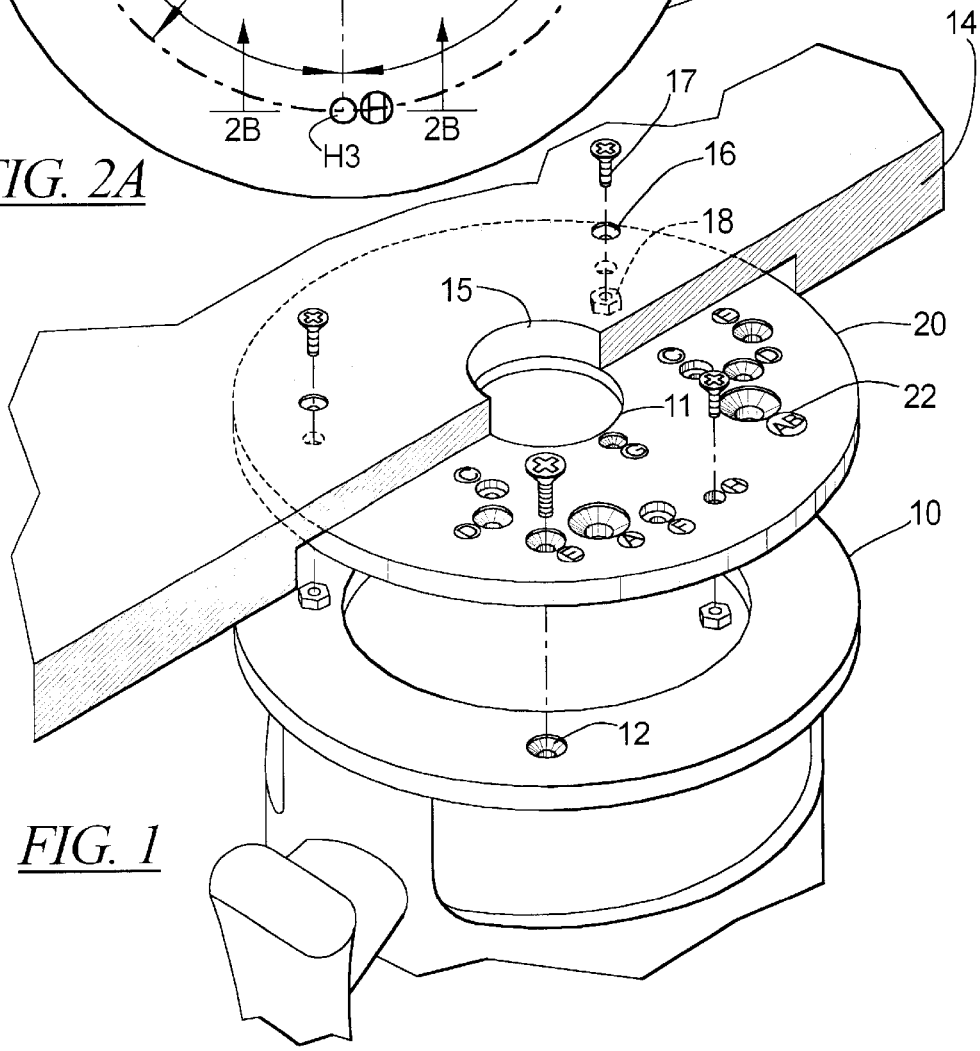
FIG. 1 is an orthogonal view of a router base plate being used to attach a router to a router table.

FIG. 1 provides an orthogonal view of the inventive router base plate 20 being used to attach a router 10 to a router table 14. The base plate 20 is fastened to the router by passing a fastening device through one of the base plate holes in a particular hole pattern grouping and into a hole in the router (exemplified by the screw passing through a hole in the hole grouping labeled "E" in FIG. 1, into the hole 12 in the router). The inventive base plate 20 may also contain hole group identifiers 22 that permit an easy determination of which holes should be used for a particular router model.

When the router has been fastened to the router base plate, forming a router-baseplate assembly, this assembly is then fastened to the router table. The router base plate has a hole pattern grouping H that lines up with an identically positioned group of holes 16 on the router table 14. A recess or inset 28 may be provided in the holes in group H to accommodate a nut 18, for example, that will permit a fastening device, such as a screw 17 to secure the router-baseplate assembly to the router table 14. Note, however, that this nut is optional, and that the baseplate itself may have some mechanism for receiving the fastener and holding it to the table, such as the holes in group H being threaded themselves. The mounting aligns the hole 15 in the router table, through which the router bit protrudes, with the large center hole 11, having an exemplary radius of approximately 22 mm or 32 mm, in the router base plate. The large center hole may have any appropriate radius to accommodate protruding router bits. In one embodiment in which the radius is approximately 22 mm, an inset 24 may be provided having a radius of approximately 26 mm that permits a guide bushing (not shown) to be attached. This inset 24 has a depth of approximately 5 mm from the bottom surface. An alternate embodiment in which the large center hole 11 is 32 mm, no inset is present.

The inventive base plate has an exemplary thickness of approximately 8 mm, although other thicknesses may be used, depending on the strength of the plate desired.

The router base plate 20 is represented in the figures by router hole pattern groupings (groups A, AB, C, D, E, and F) that serve to mount various router 10 models to the base plate 20, and by ancillary hole pattern groupings (groups G and H) that serve to secure the base plate 20 to the table 14 (group H) or to attach a guide bushing to the router plate (group G). The positions and shapes of the holes in the router hole pattern groupings are of primary importance, since these cannot be changed by the manufacturer of the router base plate. However, the positions and shapes of the holes in the ancillary hole pattern groupings are only of moderate importance since the manufacturer of the router base plate has some control over the table that the plate will mount to.

Figure 2A:
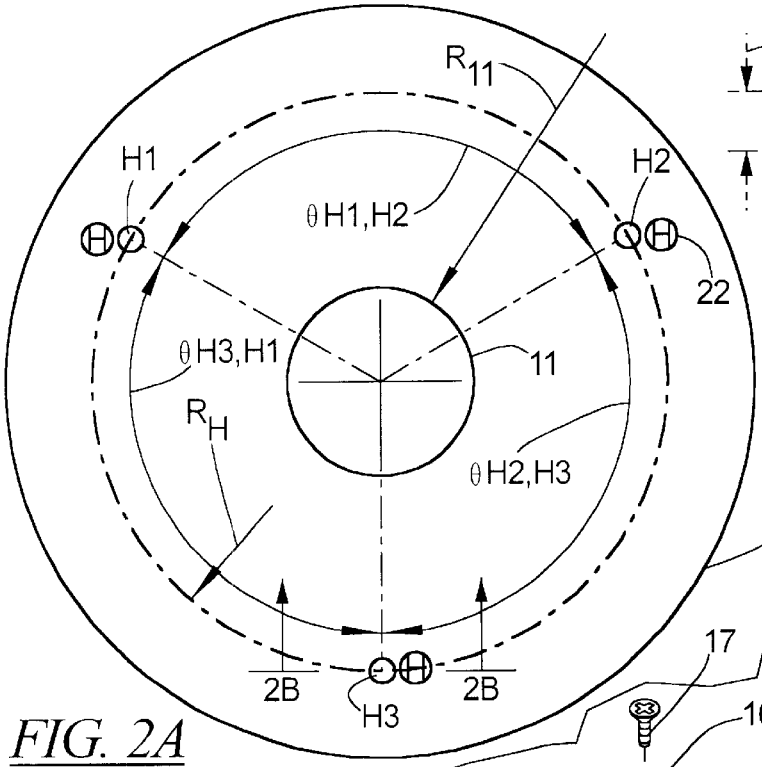
FIG. 2*a* is a top view of the router base plate and showing the hole pattern used to mount the router base plate to the router table.
Figure 2B:
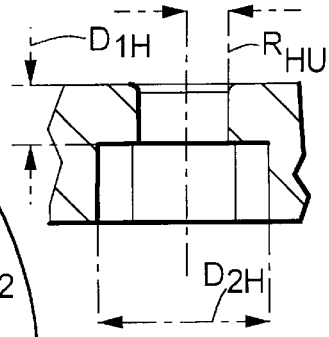
FIG. 2*b* is a section view of the mounting holes illustrated in FIG. 2*a;*

FIGS. 2*a* and 2*b* provide exemplary locations for the holes used to mount the router baseplate 20 to the table 14. In this embodiment, three holes are provided, H1, H2 and H3, all of which have a center point distance $R_H$ from a center point of the large center hole 11. Note that the positions of these mounting holes are not as important as the positions of the holes required to mount the router to the base plate, as these need only serve to affix the base plate 20 to the table 14.

In the exemplary embodiment of FIGS. 2*a* and 2*b,* the radius $R_H$ of the centers of holes H1–H3 from the center of the large center hole 11 is 68.25 mm, and each hole is separated by respective angles $\theta_{H1,H2}$, $\theta_{H2,H3}$, $\theta_{H3,H1}$ which are all 120° in this exemplary embodiment. The holes may be designed such that they can accommodate a nut having a diameter of $D_{2H}$, for example, 3.94 mm, by an inset to a bottom surface of the baseplate 20, on a side to which the router 10 mounts. The radius of holes H1–H3 on the upper surface have a radius of $R_{HU}$, that may, for example, be approximately 2.55 mm.

Figure 3:
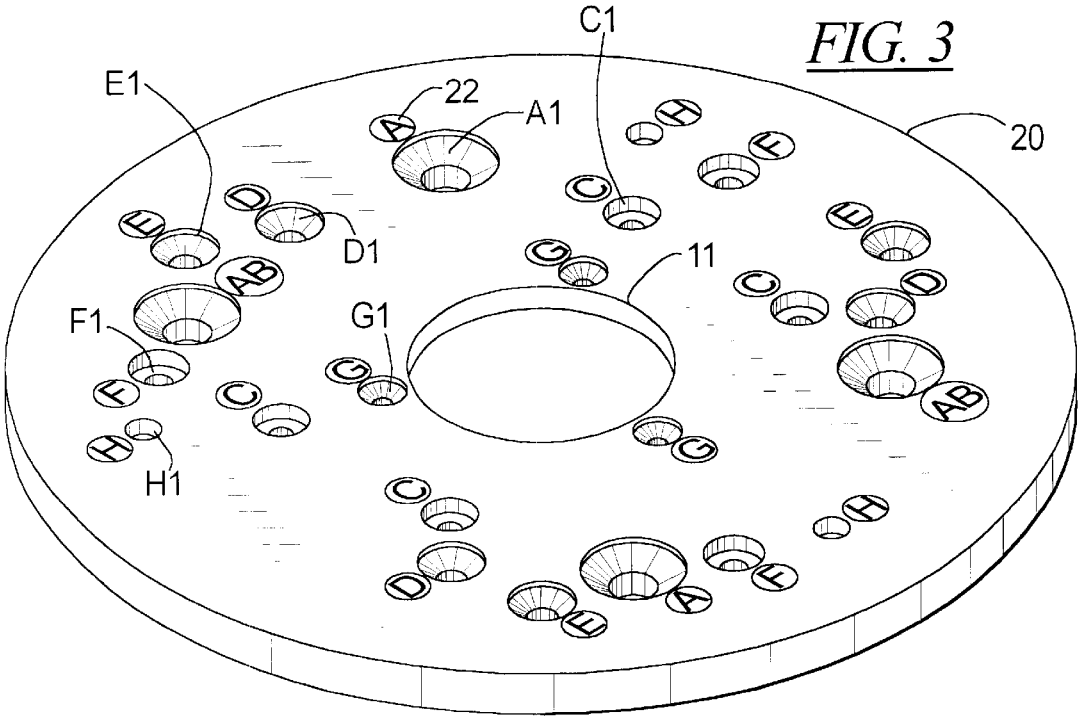
FIG. 3 is an orthogonal view of the top of the router base plate showing all of the hole pattern groupings.
Figure 4:
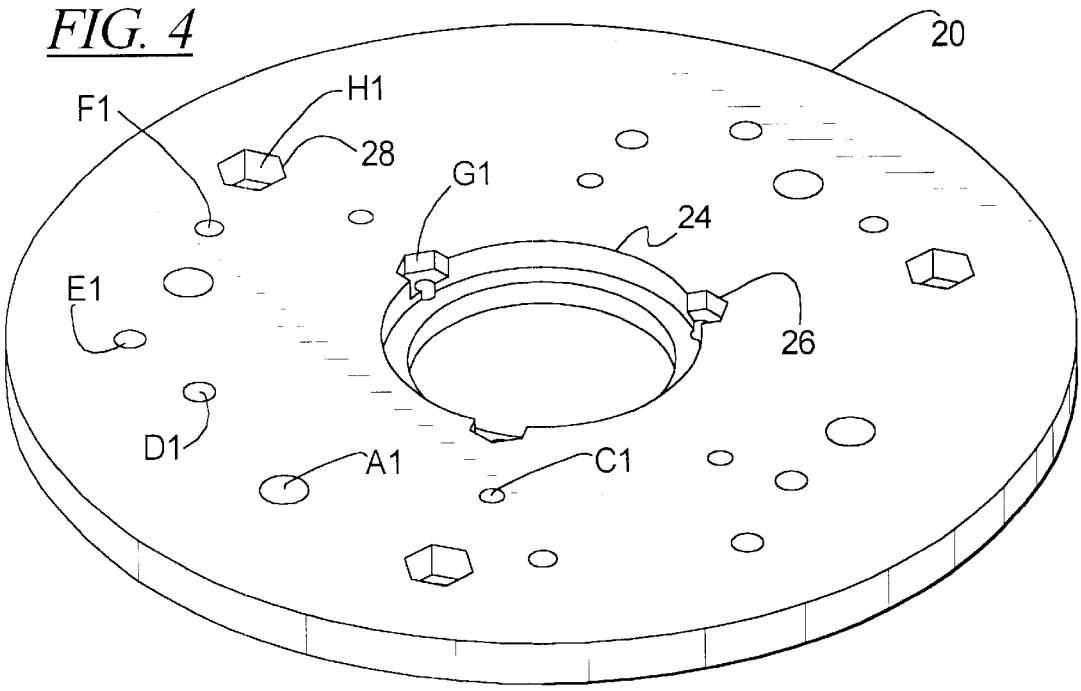
FIG. 4 is an orthogonal view of the bottom of the router base plate showing all of the hole pattern groupings.

FIG. 3 shows an orthogonal top view of the inventive router baseplate, and FIG. 4 shows an orthogonal bottom view of the router baseplate, showing the positions of all of the hole groupings in relationship to one another.

The primary hole patterns for the inventive router baseplate are provided in the remaining FIGS. 5*a*–12. Unlike the holes in hole pattern H, the hole patterns in patterns A, AB, C, D, E, F, and G are precisely specified because they are based on various router models. Each of the hole pattern groups will be identified separately below.

Figure 5A:
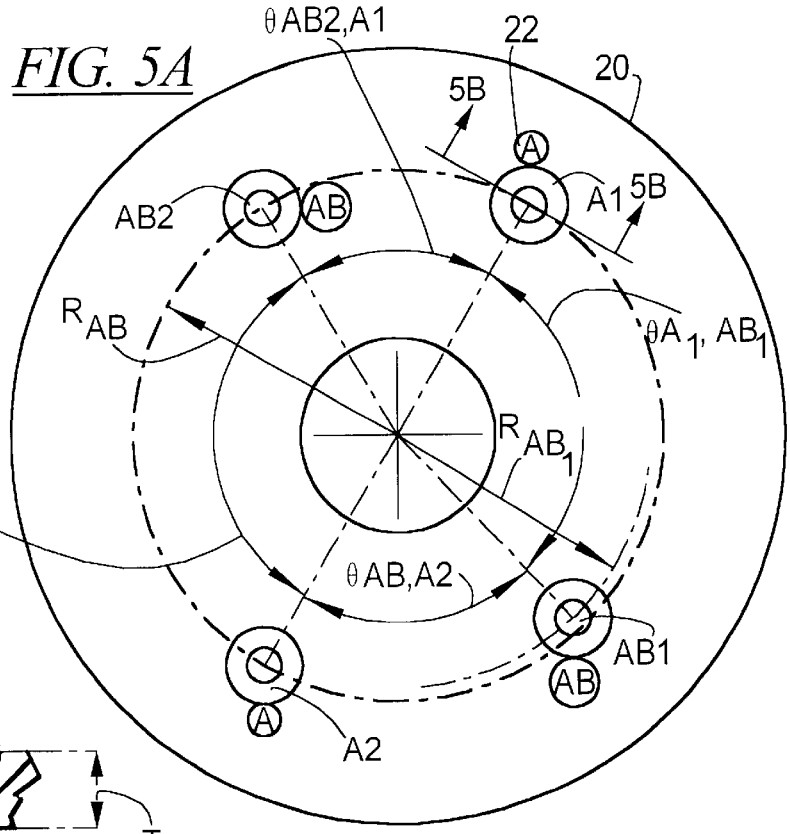
FIG. 5*a* is a top view of the router base plate showing only hole patterns A and AB.

FIG. 5*a* provides the layout of hole patterns for hole pattern groups A and AB. Hole pattern A corresponds with, for example, Ryobi™ models R160K, R160V, R166 and R180 as well as Craftsman™ models 27500, 27510, and 27511. Hole pattern B (accommodated by the pattern identified as AB) corresponds with, for example, Ryobi™ models R175 and RE175.

Figure 5B:
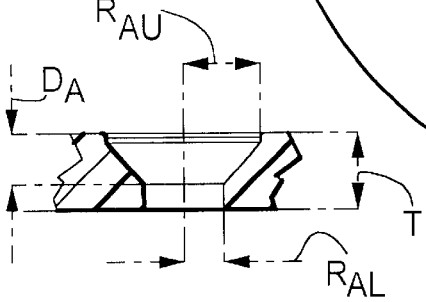
FIG. 5*b* is a section view of the holes in hole patterns A and AB.

The following parameters are identified with holes in hole patterns A and AB in FIGS. 5*a* and 5*b:*

TABLE 1

| Feature | Measurement (distances in mm) | Description |
|---|---|---|
| $R_{AB}$ | 60.97 | The distance from the large center hole 11 center to the center of holes A1, A2, and AB2. |
| $R_{AB1}$ | 58.36 | The distance from the large center hole 11 center to the center of hole AB1. |
| $\theta_{A_1,AB_1}$ | 106° | The angle separating the centers of holes A1 and AB1 with respect to the center of the large center hole 11 |
| $\theta_{AB_1,A_2}$ | 74° | The angle separating the centers of holes A2 and AB1 with respect to the center of the large center hole 11 |
| $\theta_{A_2,AB_2}$ | 119° | The angle separating the centers of holes A2 and AB2 with respect to the center of the large center hole 11. |
| $\theta_{AB_2,A_1}$ | 61° | The angle separating the centers of holes A1 and AB2 with respect to the center of the large center hole 11. |
| $R_{AL}$ | 4.1 | The non-countersink radius of holes in hole groups A and AB at a bottom surface. |
| $R_{AU}$ | 8 | The countersink radius of holes in hole groups A and AB at an upper surface. |
| $D_A$ | 5.35 | The depth of the countersink of holes in hole groups A and AB. |

Figure 6A:
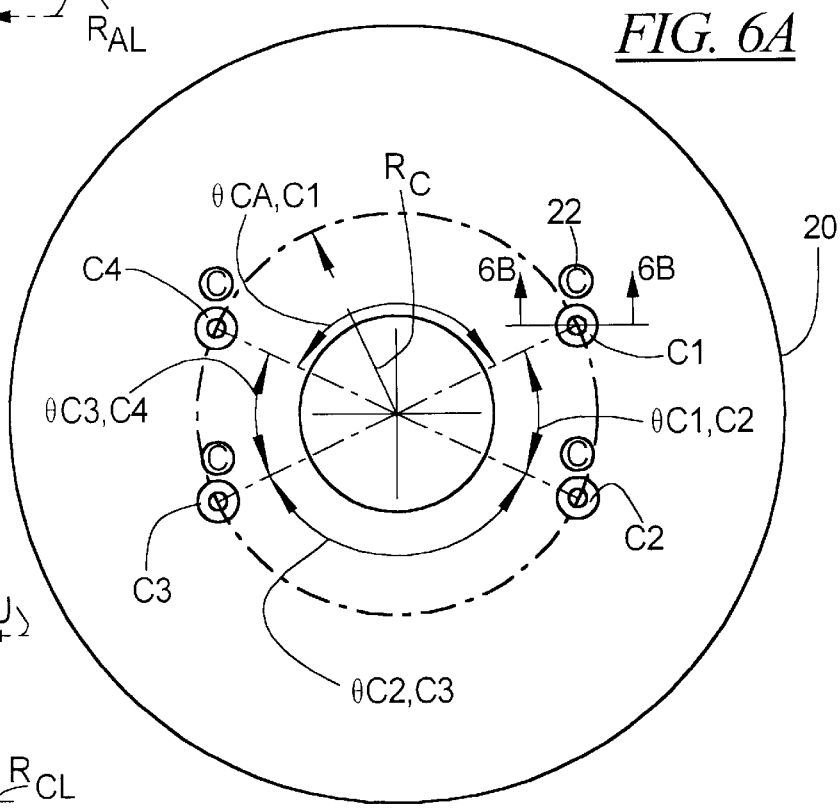
FIG. 6*a* is a top view of the router base plate showing only hole pattern C.

FIG. 6*a* provides the layout of hole patterns for hole pattern group C. Hole pattern C corresponds with, for example, Black and Decker™ models 7600 and 7604.

Figure 6B:
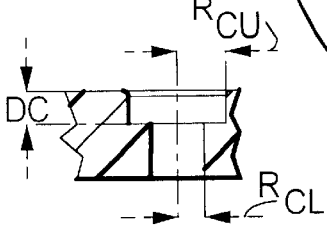
FIG. 6*b* is a section view of the holes in hole patterns C and F.

The following parameters are identified with holes in hole pattern C in FIGS. 6*a* and 6*b:*

TABLE 2

| Feature | Measurement (distances in mm) | Description |
|---|---|---|
| $R_C$ | 45.76 | The distance from the large center hole 11 center to the center of holes C1, C2, C3 and C4. |
| $\theta_{C_1,C_2}$ | 51° | The angle separating the centers of holes C1 and C2 with respect to the center of the large center hole 11. |
| $\theta_{C_2,C_3}$ | 129° | The angle separating the centers of holes C2 and C3 with respect to the center of the large center hole 11. |
| $\theta_{C_3,C_4}$ | 51° | The angle separating the centers of holes C3 and C4 with |

TABLE 2-continued

| Feature | Measurement (distances in mm) | Description |
|---|---|---|
| | | respect to the center of the large center hole 11. |
| $\theta_{C_4C_1}$ | 129° | The angle separating the centers of holes C4 and C1 with respect to the center of the large center hole 11. |
| $R_{CL}$ | 2.4 | The non-counterbored radius of holes in hole groups C and F at a bottom surface. |
| $R_{CU}$ | 4.38 | The counterbored radius of holes in hole groups C and F at an upper surface. |
| $D_C$ | 3.0 | The depth of the counterbore of holes in hole groups C and F. |

Figure 7A:
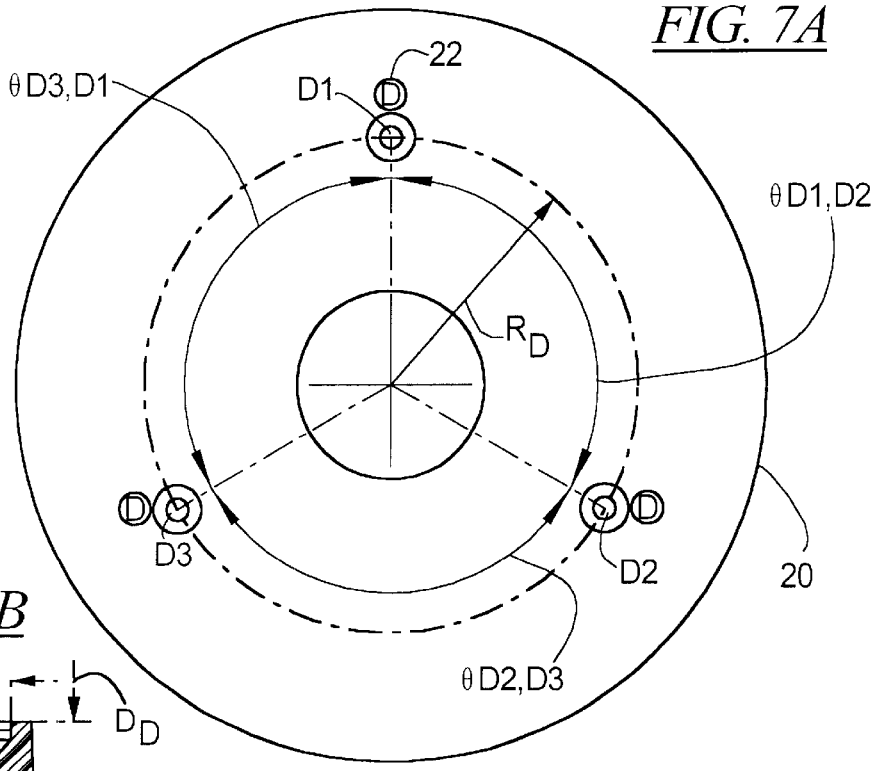
FIG. 7*a* is a top view of the router base plate showing only hole pattern D.

FIG. 7*a* provides the layout of hole patterns for hole pattern group D. Hole pattern D corresponds with, for example, Porter Cable™ models 690 and 6931.

Figure 7B:
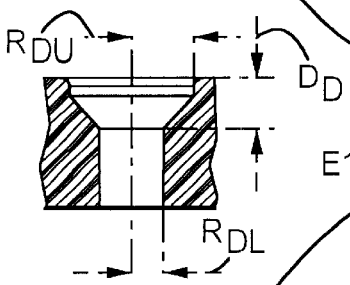
FIG. 7*b* is a section view of the holes in hole patterns D and E.

The following parameters are identified with holes in hole pattern D in FIGS. 7*a* and 7*b:*

TABLE 3

| Feature | Measurement (distances in mm) | Description |
|---|---|---|
| $R_D$ | 58.75 | The distance from the large center hole 11 center to the center of holes D1, D2 and D3. |
| $\theta_{D_1,D_2}$ | 120° | The angle separating the centers of holes D1 and D2 with respect to the center of the large center hole 11. |
| $\theta_{D_2,D_3}$ | 120° | The angle separating the centers of holes D2 and D3 with respect to the center of the large center hole 11. |
| $\theta_{D_3,D_1}$ | 120° | The angle separating the centers of holes D3 and D1 with respect to the center of the large center hole 11 |
| $R_{DL}$ | 2.55 | The non-countersink radius of holes in hole groups D and E at a bottom surface. |
| $R_{DU}$ | 5.0 | The countersink radius of holes in hole groups D and E at an upper surface. |
| $D_D$ | 3.7 | The depth of the countersink of holes in hole groups D and E. |

Figure 8:
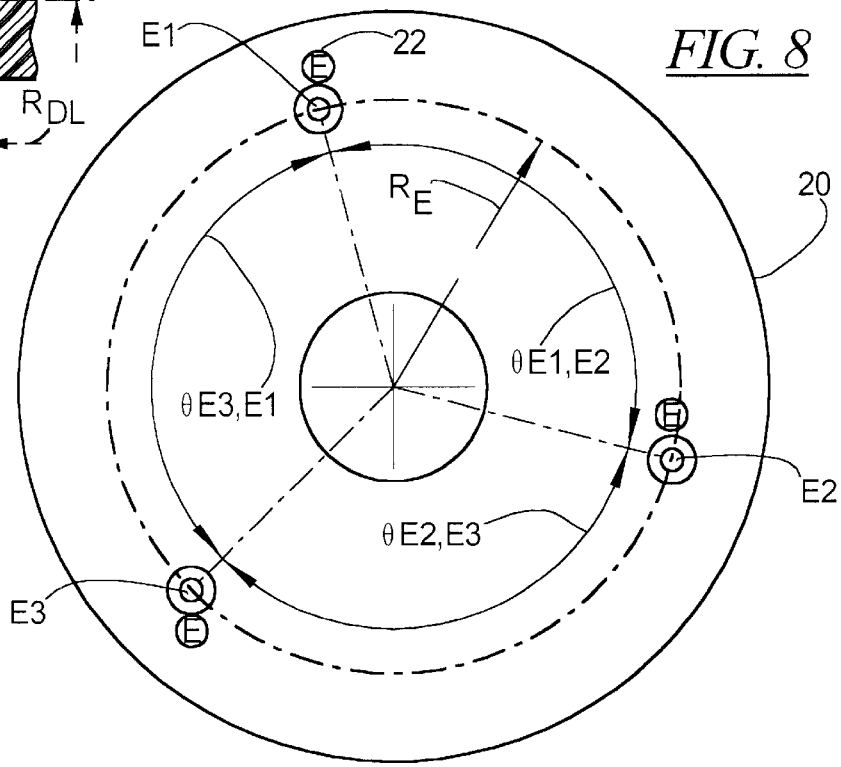
FIG. 8 is a top view of the router base plate showing only hole pattern E.

FIG. 8 provides the layout of hole patterns for hole pattern group E. Hole pattern E corresponds with, for example, Skil™ models 1823, 1835 and 1845-02, or Craftsman™ models 17504, 17505, and 17506.

The following parameters are identified with holes in hole pattern E in FIG. 8:

TABLE 4

| Feature | Measurement (distances in mm) | Description |
|---|---|---|
| $R_E$ | 68.25 | The distance from the large center hole 11 center to the center of holes E1, E2 and E3. |
| $\theta_{E_1,E_2}$ | 120° | The angle separating the centers of holes E1 and E2 with respect to the center of the large center hole 11. |
| $\theta_{E_2,E_3}$ | 120° | The angle separating the centers of holes E2 and E3 with respect to the center of the large center hole 11. |
| $\theta_{E_3,E_1}$ | 120° | The angle separating the centers of holes E3 and E1 with respect to the center of the large center hole 11. |

Note that the radius and countersink dimensions for holes in group E are identical to those in group D.

FIG. 9 provides the layout of hole patterns for hole pattern group F. Hole pattern F corresponds with, for example, Black and Decker™ model 7612, or Dewalt™ model DW 610.

The following parameters are identified with holes in hole pattern F in FIG. 9:

TABLE 5

| Feature | Measurement (distances in mm) | Description |
|---|---|---|
| $R_F$ | 63.5 | The distance from the large center hole 11 center to the center of holes F 1, F2 and F3. |
| $\theta_{F_1,F_2}$ | 120° | The angle separating the centers of holes F1 and F2 with respect to the center of the large center hole 11. |
| $\theta_{F_2,D_3}$ | 120° | The angle separating the centers of holes F2 and F3 with respect to the center of the large center hole 11. |
| $\theta_{F_3,D_1}$ | 120° | The angle separating the centers of holes F3 and F1 with respect to the center of the large center hole 11 |

Note that the radius and counterbore dimensions for holes in group F are identical to those in group C.

FIG. 10*a* provides the layout of hole patterns for hole pattern group G. Hole pattern G is provided to permit the attachment of a guide bushing to the router base plate.

The following exemplary parameters are identified with holes in hole pattern G in FIGS. 10*a* and 10*b:*

TABLE 6

| Feature | Measurement (distances in mm) | Description |
|---|---|---|
| $R_G$ | 27.2 | The distance from the large center hole 11 center to the center of holes G1, G2 and G3. |
| $\theta_{G_1,G_2}$ | 120° | The angle separating the centers of holes G1 and G2 with respect to the center of the large center hole 11. |
| $\theta_{G_2,G_3}$ | 120° | The angle separating the centers of holes G2 and G3 with respect to the center of the large center hole 11. |
| $\theta_{G_3,G_1}$ | 120° | The angle separating the centers of holes G3 and G1 with respect to the center of the large center hole 11. |
| $R_{GL}$ | 1.78 | The non-countersink radius of holes in hole group G at their narrowest portion. |
| $R_{GU}$ | 3.38 | The countersink radius of holes in hole group G at an upper surface. |
| $D_{1G}$ | 2.8 | The depth of the countersink of holes in hole group G. |
| $D_{2G}$ | 2.23 | The depth of the hole below the countersink, but above the fastener inset of holes in hole group G. |
| $D_{3G}$ | 3.55 | The width of the fastener inset 26 on the lower surface of the baseplate, as truncated by an inset 24 of the large center hole 11 of holes in hole group G. |

Figure 11:
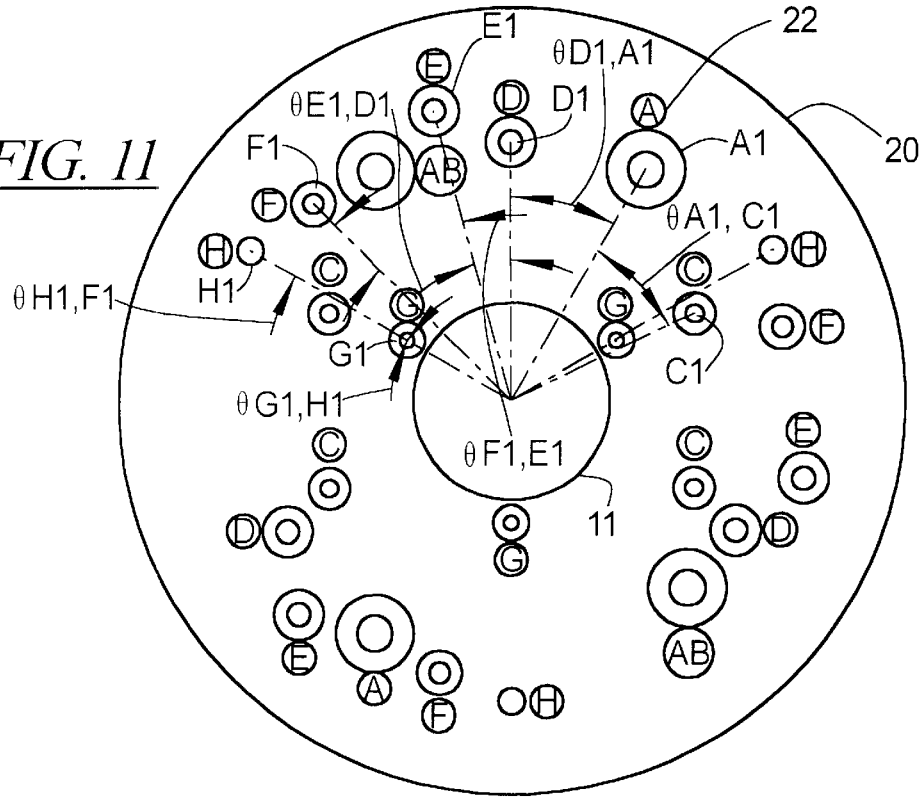
FIG. 11 is a top view of the router base plate showing all of the hole patterns combined.
Figure 12:
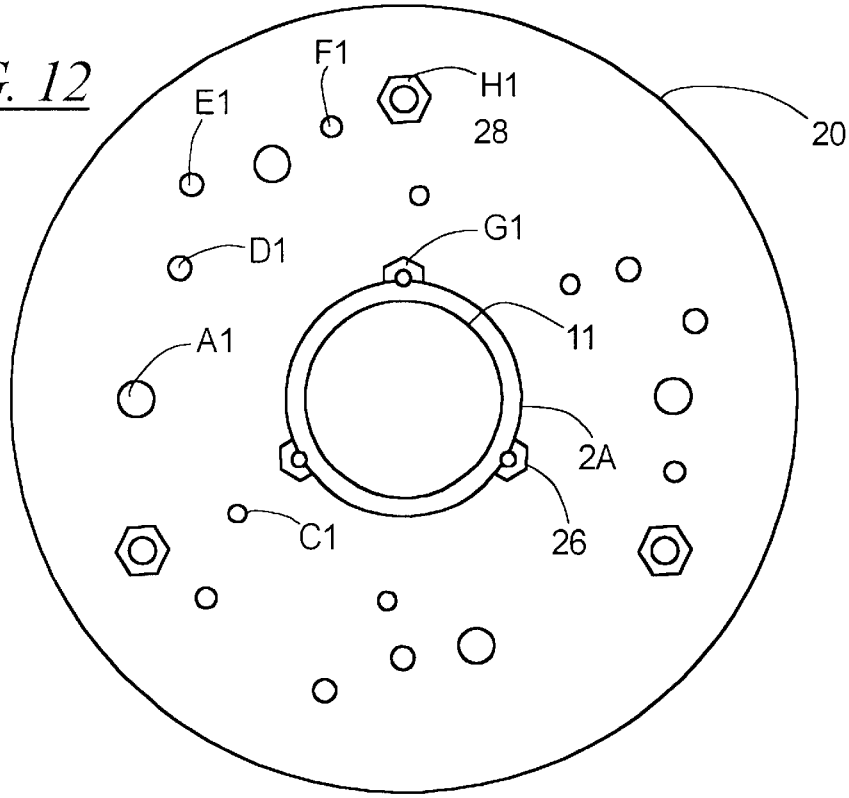
FIG. 12 is a bottom view of the router base plate showing all of the hole patterns combined.

FIG. 11 provides the layout of all of the hole pattern groupings combined, as they would appear in an actual embodiment of the invention. This figure is provided to show the angular relationships of all of the hole pattern groupings with respect to one another.

The following exemplary parameters are identified in FIG. 11:

TABLE 7

| Feature | Measurement (distances in mm) | Description |
|---|---|---|
| $\theta_{g_1,H_1}$ | 0° | The angle separating the centers of holes G1 and H1 with respect to the center of the large center hole 11. These holes are co-linear with the radius |
| $\theta_{H_1,F_1}$ | 15° | The angle separating the centers of holes H1 and F1 with respect to the center of the large center hole 11 |
| $\theta_{F_1,E_1}$ | 30° | The angle separating the centers of holes FI and E1 with respect to the center of the large center hole 11. |
| $\theta_{E_1,D_1}$ | 15° | The angle separating the centers of holes E1 and D1 with |

TABLE 7-continued

| Feature | Measurement (distances in mm) | Description |
|---|---|---|
| | | respect to the center of the large center hole 11. |
| $\theta_{D_1,A_1}$ | 31° | The angle separating the centers of holes D1 and A1 with respect to the center of the large center hole 11. |
| $\theta_{A_1,C_1}$ | 34° | The angle separating the centers of holes A1 and C1 with respect to the center of the large center hole 11. |

Note that in an embodiment where the hole patterns are provided directly in the router table, the router is simply attached to the table in the same manner as the preceding example describes attaching the router to the base plate.

These hole groupings provide a unique and nonobvious pattern for slotless a router base plate in that they accommodate the vast majority of routers on the market today, while at the same time providing a strong mounting for a router requiring little effort by a user to mount.

The above-described router base plate adapter is illustrative of the principles of the present invention. Numerous modifications and adaptations thereof will be readily apparent to those skilled in this art without departing from the spirit and scope of the present invention.

What is claimed is:

1. A slotless router base plate adapter with a center hole having a center point, comprising:

at least six hole groups comprising a first hole group through a sixth hole group, each said hole group comprising more than one hole.

2. A slotless router base plate adapter according to claim 1, wherein:

said first hole group comprises a first hole and a second hole, both said first hole of said first group and said second hole of said first group being a distance $R_{AB}$ from said center point, and said first hole of said first group and said second hole of said first group being separated by an angle of 180°;

said second hole group comprises a first hole and a second hole, said first hole of said second hole group being a distance $R_{AB1}$ from said center point, said second hole of said second hole group being said distance $R_{AB}$ from said center point, and said first hole of said second group and said second hole of said second group being separated by an angle of $\theta_{AB2,A1}+\theta_{A1,AB1}$, and said first hole of said first group and said first hole of said second group being separated by an angle of $\theta_{A1,AB1}$;

said third hole group comprises a first through a fourth hole, all of which are a distance $R_C$ from said center point, said second hole of said third group being separated by an angle of $\theta_{C1,C2}$ from said first hole of said third hole group, said third hole of said third group being separated by an angle of $\theta_{C2,C3}$ from said second hole of said third hole group, and said fourth hole of said third group being separated by an angle of $\theta_{C3,C4}$ from said first hole of said third hole group, said angle $\theta_{C1,C2}$ being equal to $\theta_{C3,C4}$;

said fourth hole group comprises a first through a third hole, all of which are a distance $R_D$ from said center point, and all holes of said fourth group are separated from one another by an angle of 120°;

said fifth hole group comprises a first through a third hole, all of which are a distance $R_E$ from said center point, and all holes of said fifth group are separated from one another by an angle of 120°; and said sixth hole group comprises a first through a third hole, all of which are a distance $R_F$ from said center point, and all holes of said sixth group are separated from one another by an angle of 120°;

said first hole of said fifth group being separated from said first hole in said sixth group by an angle $\theta_{F1,E1}$;

said first hole of said fourth group being separated from said first hole in said fifth group by an angle θE1,D1;

said first hole of said fourth group being separated from said first hole in said first group by an angle $\theta_{D1,A1}$; and said first hole of said first group being separated from said first hole in said third group by an angle $\theta_{A1,C1}$.

3. The slotless router base plate adapter according to claim 2, further comprising:

identification markings by each hole in said at least six hole groups that identify which group each hole belongs to.

4. The slotless router base plate adapter according to claim 2, wherein:

said holes of said first hole group and said holes of said second hole group have a radius $R_{AL}$;

said holes of said third hole group and said sixth hole group have a radius $R_{CL}$; and said holes of said third hole group and said holes of said fourth hole group have a radius $R_{DL}$.

5. The slotless router base plate adapter according to claim 4, wherein:

said holes of said first hole group and said holes of said second hole group have a countersink radius $R_{AU}$ and a countersink depth of $D_A$;

said holes of said third hole group and said sixth hole group have a counterbore radius $R_{CU}$ and a counterbore depth of $D_C$;

said holes of said third hole group and said holes of said fourth hole group have a countersink radius $R_{DU}$ and a countersink depth of $D_D$.

6. The slotless router base plate adapter according to claim 2, wherein said router base plate is round.

7. The slotless router base pate adapter according to claim 5, further comprising:

identification markings by each hole in said at least six hole groups that identify which group each hole belongs to.

8. The slotless router base plate adapter according to claim 3, wherein said router base plate is round.

9. The slotless router base plate adapter according to claim 7, wherein said router base plate is round.

10. The slotless routerbase plate adapter according to claim 2, further comprising:

a seventh hole group that comprises a first through a third hole, all of which are a distance $R_G$ from said center point, and all holes of said seventh group are separated from one another by an angle of 120°.

11. The slotless router base plate adapter according to claim 10, wherein:

said first hole of said seventh group is separated from said first hole in said sixth group by an angle $\theta_{G1,F1}$.

12. The slotless router base plate adapter according to claim 10, wherein:

said holes of said seventh hole group have a radius $R_{GL}$, a countersink radius $R_{DU}$ and a countersink depth of $D_D$.

13. The slotless router base plate adapter according to claim 2, further comprising:

an eighth hole group that comprises a first through a third hole, all of which are a distance $R_H$ from said center point, and all holes of said seventh group are separated from one another by an angle of 120°; said holes in said eighth group have a contoured inset for holding a fastening nut.

14. The slotless router base plate adapter according to claim 13, wherein:

said holes in said eighth group have a contoured inset for holding a fastening nut.

15. The slotless router base plate adapter according to claim 3, wherein said identification markings are provided in relief in the base plate itself.

* * * * *